US006128900A

United States Patent [19]

Atkins et al.

[11] Patent Number: 6,128,900

[45] Date of Patent: Oct. 10, 2000

[54] HYDRAULIC FLUID SUPPLY SYSTEM

[75] Inventors: Richard A. Atkins, Dallas City, Ill.; Richard J. Lech, Burlington, Iowa; Curtis R. Lyons, Burlington, Iowa; Michael G. Nahorny, Burlington, Iowa; Robert T. Peterson, Gladstone, Ill.; Robert E. Wawiorka, Burlington, Iowa

[73] Assignee: Case Corporation, Racine, Wis.

[21] Appl. No.: 09/014,823

[22] Filed: Jan. 28, 1998

[51] Int. Cl.[7] ..... F15B 13/044

[52] U.S. Cl. ..... 60/421; 60/429; 91/453

[58] Field of Search ..... 60/421, 429, 430; 91/427, 453; 100/269.14, 269.15, 269.16

[56] References Cited

U.S. PATENT DOCUMENTS

| | | | |
|---|---|---|---|
| 1,913,663 | 6/1933 | Ferris | 91/453 |
| 2,643,515 | 6/1953 | Harsch | 91/527 |
| 3,777,629 | 12/1973 | Johnston et al. | 606/484 |
| 3,889,586 | 6/1975 | Pretty | 100/269.16 |
| 5,081,837 | 1/1992 | Ueno | 60/430 |
| 5,148,676 | 9/1992 | Moriya et al. | 60/430 |
| 5,235,811 | 8/1993 | Arii et al. | 60/484 |

FOREIGN PATENT DOCUMENTS

| | | | |
|---|---|---|---|
| 27743 | 4/1981 | European Pat. Off. | 60/421 |

*Primary Examiner*—F. Daniel Lopez
*Attorney, Agent, or Firm*—Foley & Lardner

[57] ABSTRACT

A system for supplying an implement with hydraulic fluid includes a first hydraulic pump generating a first flow, a second hydraulic pump generating a second flow and a valve assembly adapted to be coupled to the implement and coupled to the first and second flows. The valve assembly couples the first flow to the implement. The valve assembly also selectively adds the second flow to the first flow to provide a low flow or a high flow. The valve assembly couples the first flow to the implement via a first coupling in response to a first signal and via a second coupling in response to a second signal. The system further includes a manually operable control coupled to the valve assembly and movable between the first position which the first signal is generated, a second position in which the second signal is generated and a third position in which a third signal is generated. The system also includes a foot pedal control coupled to the manually operable control and to the valve assembly. The foot pedal generates the first signal in response to the third signal and actuation of the foot pedal control.

2 Claims, 7 Drawing Sheets

HYDRAULIC FLUID SUPPLY SYSTEM

FIELD OF THE INVENTION

The present invention relates to a system for supplying an implement with hydraulic fluid. In particular, the present invention relates to a system for selectively supplying the implement with either a high volume of flow or a low volume of flow. The present invention is also directed to a system having a manually operable control movable between three positions for providing bi-directional hydraulic flow to the implement and for activating foot pedal control of the system.

BACKGROUND OF THE INVENTION

Various machines and vehicles, such as tractors, utilize hydraulic systems for transmitting power to implements or tools coupled to the machine or vehicle. For example, back hoes usually use hydraulics to power implements or tools such as jackhammers and augers. The rate at which the implements are moved is typically varied by adjusting the hydraulic flow to the implement. This is typically achieved by adjusting the throttle or RPM up or down to increase or decrease hydraulic flow to the implement.

Many existing older and smaller implements require a relatively low volume flow of hydraulic fluid to operate. To reduce the hydraulic flow to these low flow implements, the vehicle or machine must be throttled down. In some low flow implements, larger machines must be throttled all the way down so as to run at idle. Although throttling the machine or vehicle down accommodates the low flow requirements of such implements, throttling the machine or vehicle down also reduces power. As a result, powering implements that also require large pressures, for example, hammers, result in the engine being killed.

To lower the flow while maintaining throttle or RPM, some systems employ a flow divider or a pressure reducing valve which diverts a large amount of the flow to the sump or tank. Although the use of such diverters enable such systems to reduce the hydraulic flow to the implement while maintaining throttle or RPM, the flow subtracted or diverted to the sump or tank is at high pressure. Because this diversion or flow occurs after exiting major valves, substantial heat is generated resulting in large parasitic losses. Consequently, hydraulic systems which utilize flow diverters to reduce flow to accommodate low flow implements are very inefficient.

As a result, there is a continuing need for a system for supplying hydraulic fluid to an implement that is capable of providing both high flow rates and low flow rates at a given throttle or RPM without heat generation and parasitic losses.

Convention hydraulic systems for supplying hydraulic fluid to implements are controlled by actuating a plurality of different control levers and/or switches. Typically, such systems include a manually operable control for providing bi-directional hydraulic flow to the implement. To free the operator's hands for actuating other controls, conventional systems also include a foot pedal control for providing hydraulic flow to the implement in a single direction. Shifting from manual bi-directional flow control to a single directional flow foot pedal control is typically achieved by shifting the manual control to a neutral position and by further actuating a switch, such as a rocker switch. As a result, shifting between bi-directional flow control and foot pedal flow control requires multiple steps and consume valuable time. Moreover, the multiple manual control levers and/or switches consume valuable control console space and make the design of an ergonomic and user friendly control layout more difficult.

As a result, there is also a continuing need for a system for supplying hydraulic fluid to an implement that provides manual or foot pedal flow control and that preserves console space, is simple and easy to use and manipulate.

SUMMARY OF THE INVENTION

The present invention is directed to the system for supplying an implement with hydraulic fluid. The system includes a first hydraulic pump generating a first flow, a second hydraulic pump generating a second flow and a valve assembly adapted to be coupled to the implement and coupled to the first and second flows. The valve assembly couples the first flow to the implement and selectively adds the second flow to the first flow.

In accordance with one aspect of the present invention, the valve assembly is adapted to be coupled to the implement via a first coupling and via a second coupling, wherein the valve assembly selectively couples the first flow to the implement via one of the first and second couplings. In one embodiment, the valve assembly couples the first flow to the implement via the first coupling in response to a first signal and couples the first flow to the implement via the second coupling in response to a second signal. With this embodiment, the system additionally includes a manually operable control and a foot pedal control. The manually operable control is coupled to the valve assembly and is movable between a first position at which the first signal is generated, a second position at which the second signal is generated and a third position at which a third signal is generated. The foot pedal control is coupled to the manually operable control and to the valve assembly. The foot pedal generates the first signal in response to the third signal and actuation of the foot pedal control.

In accordance with another aspect of the present invention, the valve assembly selectively couples the first flow to the implement. In accordance with yet another aspect of the present invention, the valve assembly adds the second flow to the first flow in response to a first signal, wherein the system includes an electronic switch coupled to the valve assembly for generating the first signal. In accordance with yet another aspect of the present invention, the system includes a sump and a valve coupled to the second flow for selectively coupling the second flow to the sump. In accordance with another aspect of the present invention, the system includes a sump and a valve coupled to the first flow in the sump. The valve couples the first flow to the sump until the valve receives one of the first and second signals.

The present invention is also directed to a system for supplying an implement with hydraulic fluid. The system includes a first hydraulic pump generating a first flow, a valve assembly coupled to the first hydraulic pump and adapted to be coupled to the implement via a first coupling and via a second coupling, a manually operable control coupled to the valve assembly and a foot pedal control coupled to the manually operable control and to the valve assembly. The valve assembly couples the first pump to the implement via the first coupling in response to a first signal and couples the pump to the implement via the second coupling in response to a second signal. The manually operable control moves between a first position at which the first signal is generated, a second position at which a second signal is generated, and a third position at which a third signal is generated. The foot pedal control generates the first signal in response to the third signal and actuation of the foot pedal control.

DETAILED DESCRIPTION OF THE PREFERRED EMBODIMENTS

Figure 1:
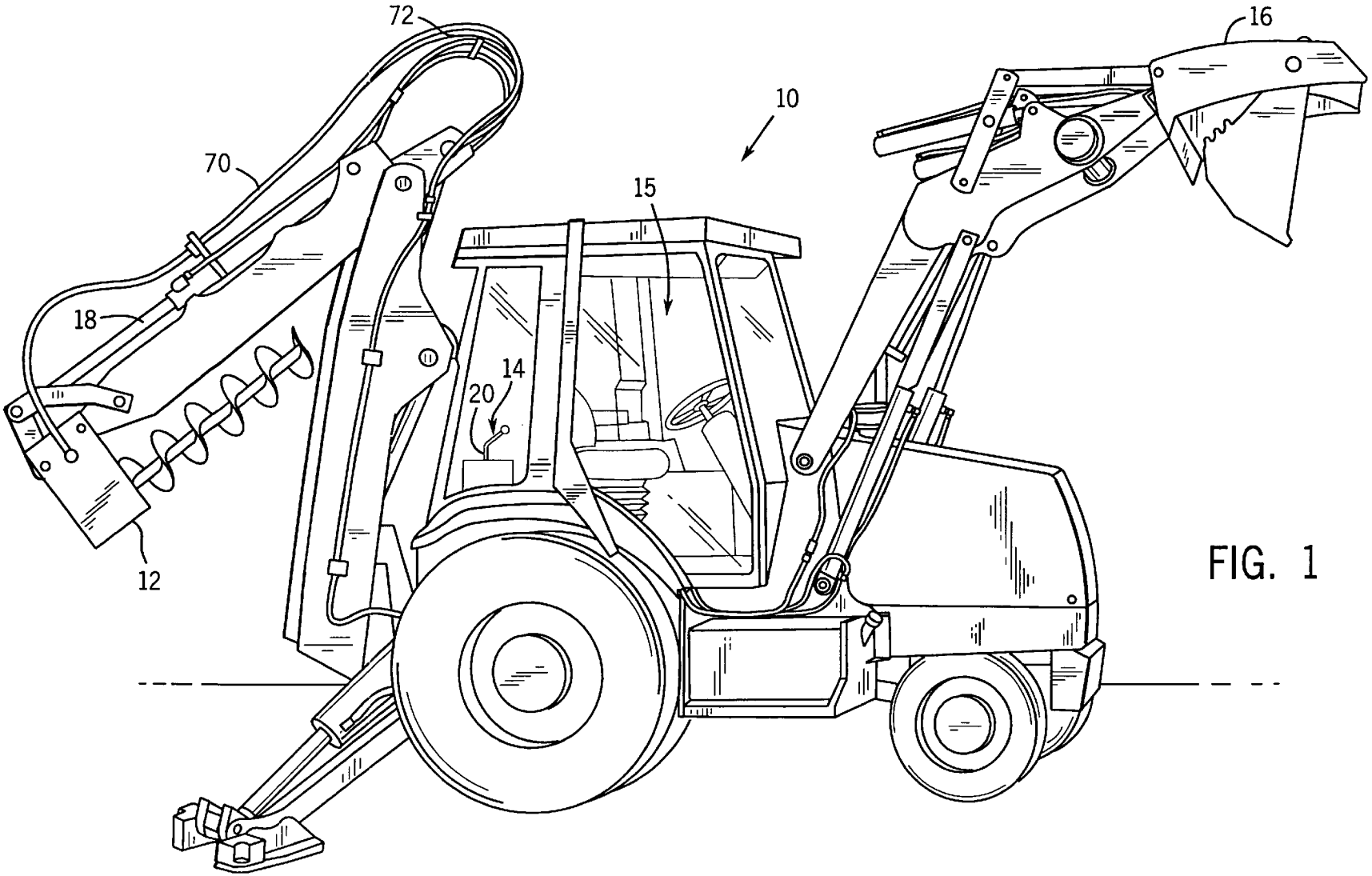
FIG. 1 is a perspective view of a vehicle equipped with an implement and a hydraulic fluid supply system of the present invention for supplying hydraulic fluid to the implement.

FIG. 1 is a perspective view of a machine or a vehicle 10 equipped with an implement 12 and a hydraulic fluid supply system 14 for supplying hydraulic fluid to implement 12 to power implement 12. Vehicle 10 is illustrated as comprising a conventionally known loader/back hoe tractor 10 having a hydraulically actuated front loader or bucket 16 and a back hoe 18. Back hoe 18 is adapted to support and actuate any of a plurality of well-known implements, such as hammers, augers and the like. Back hoe 18 is configured for supporting and actuating implements requiring high hydraulic flows and low hydraulic flows. In the example illustrated, implement 12 comprises an auger supported by back hoe 18. Implement 12 is hydraulically powered by hydraulic fluid supply system 14.

Hydraulic fluid supply system 14 is supported by vehicle 10 and selectively supplies hydraulic fluid under pressure to the implement 12 to drive or power implement 12. Hydraulic fluid supply system 14 enables implement 12 to be alternatively supplied with a high flow of hydraulic fluid or a low flow of hydraulic fluid, depending upon the requirements of implement 12, while at the same time maintaining an elevated throttle or RPM during the provision of both the high and low flows. In addition, hydraulic fluid supply system 14 includes a control system 20 that enables the operator to bi-directionally control the hydraulic flow from system 14 and to shift between the manually operated bi-directional flow control of system 14 to a foot pedal controlled flow of system 14 by manipulating a single manual control. As a result, control system 20 of hydraulic fluid supply system 14 utilizes less console space and is simple as well as easy to manipulate and control.

FIGS. 2–5 schematically illustrate hydraulic fluid supply system 14 in various modes. System 14 generally includes hydraulic pump 30, hydraulic pump 32, flow control 40, valve assembly 44, sump 46 (also known as tank or reservoir), and electric power source 48. Hydraulic pump 30 comprises a conventionally known hydraulic pump configured for being driven so as to generate a first flow of hydraulic fluid. Hydraulic pump 32 also comprises a conventionally known hydraulic pump configured for being driven so as to generate a second distinct flow of hydraulic fluid. Preferably, hydraulic pump 30 generates a hydraulic flow in the range of 28 gallons per minute maximum flow. Hydraulic pump 32 generates a hydraulic flow in the range of 10 gallons per minute maximum flow. Each of hydraulic pumps 30 and 32 is fluidly coupled to valve assembly 44. As can be appreciated, the size of pumps 30 and 32 may be raised depending upon particular applications of system 14.

Figure 6:
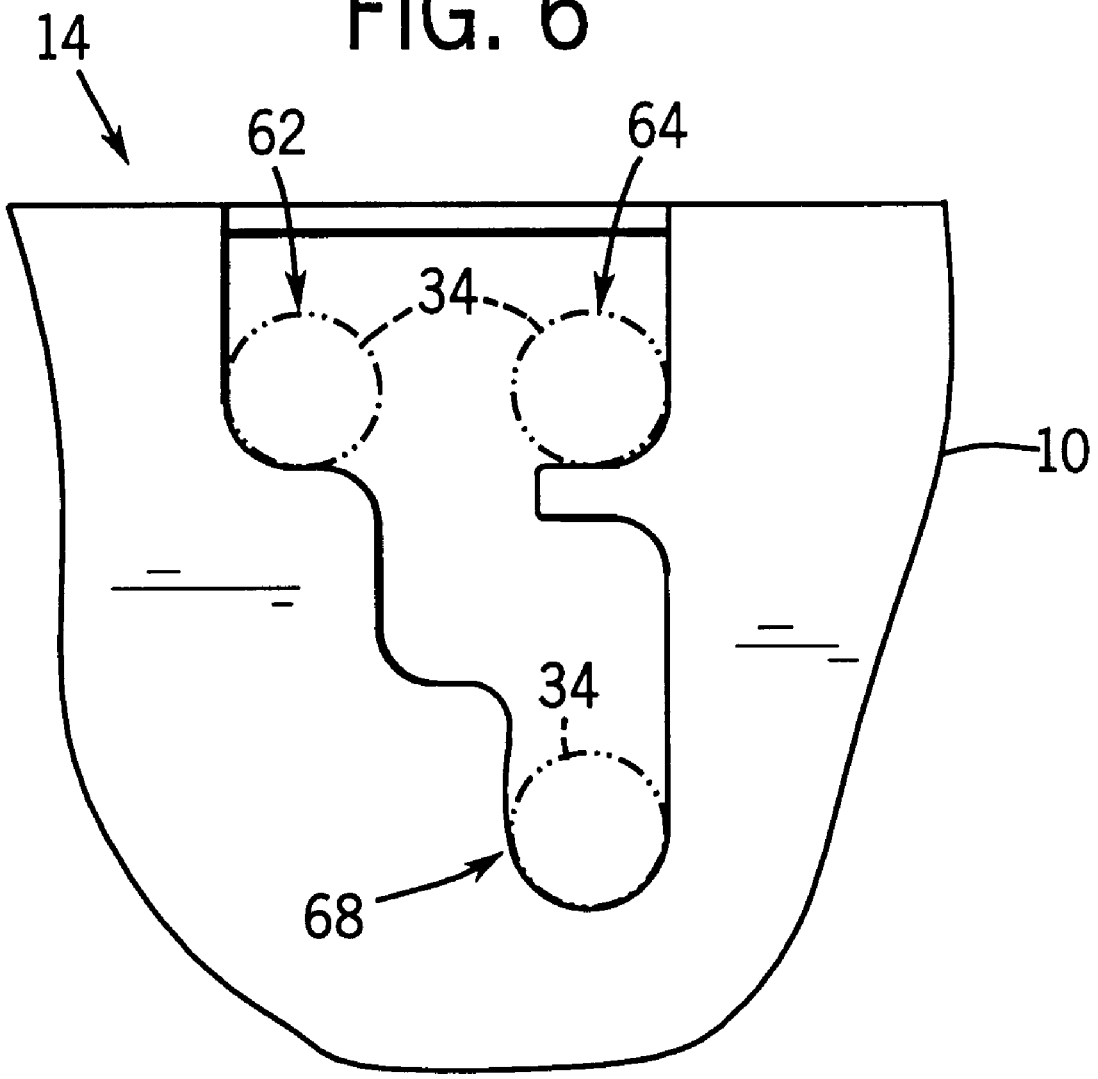
FIG. 6 is a fragmentary top plan view of the vehicle and the manually operable control illustrating the manually operable control shifted between three control positions.

Manually operable control 34 is coupled to valve assembly 44 and switch 36. As best shown by FIG. 6, manually operable control 34 is configured for movement between at least three distinct positions, 62, 64 and 68. At position 62, manually operable control 34 generates a control signal, in a conventionally known manner, which is received by valve assembly 44 to cause valve assembly 44 to selectively couple at least one of hydraulic pumps 30 and 32 to implement 12 via hydraulic coupling 70. At position 64, manually operable control 34 generates a control signal, in a conventionally known manner, which is received by valve assembly 44 and which cause valve assembly 44 to couple at least one of hydraulic pumps 30 and 32 to implement 12 via hydraulic coupling 72. As a result, shifting of manually operable control 34 between positions 62 and 64 (into and out of FIG. 2) causes valve assembly 44 to supply hydraulic fluid to implement 12 in opposite directions for forward and reverse operation of implement 12. Thus, manually operable control lever 34 controls valve assembly 44 to provide bi-directional hydraulic power to implement 12.

At position 68, manually operable control 34 cooperates with switch 36 through a mechanical linkage to generate a control signal which is received by foot pedal control 38. Switch 36 comprises a conventionally known micro switch electrically coupled to power source 48, foot pedal control 38 and valve assembly 44 via electrical conductors 69. Switch 36 alternately conducts electrical current from power source 48 to either of foot pedal control 38 or valve assembly 44 for bi-directional manual flow control or foot pedal flow control, respectively, of system 14.

Figure 2:
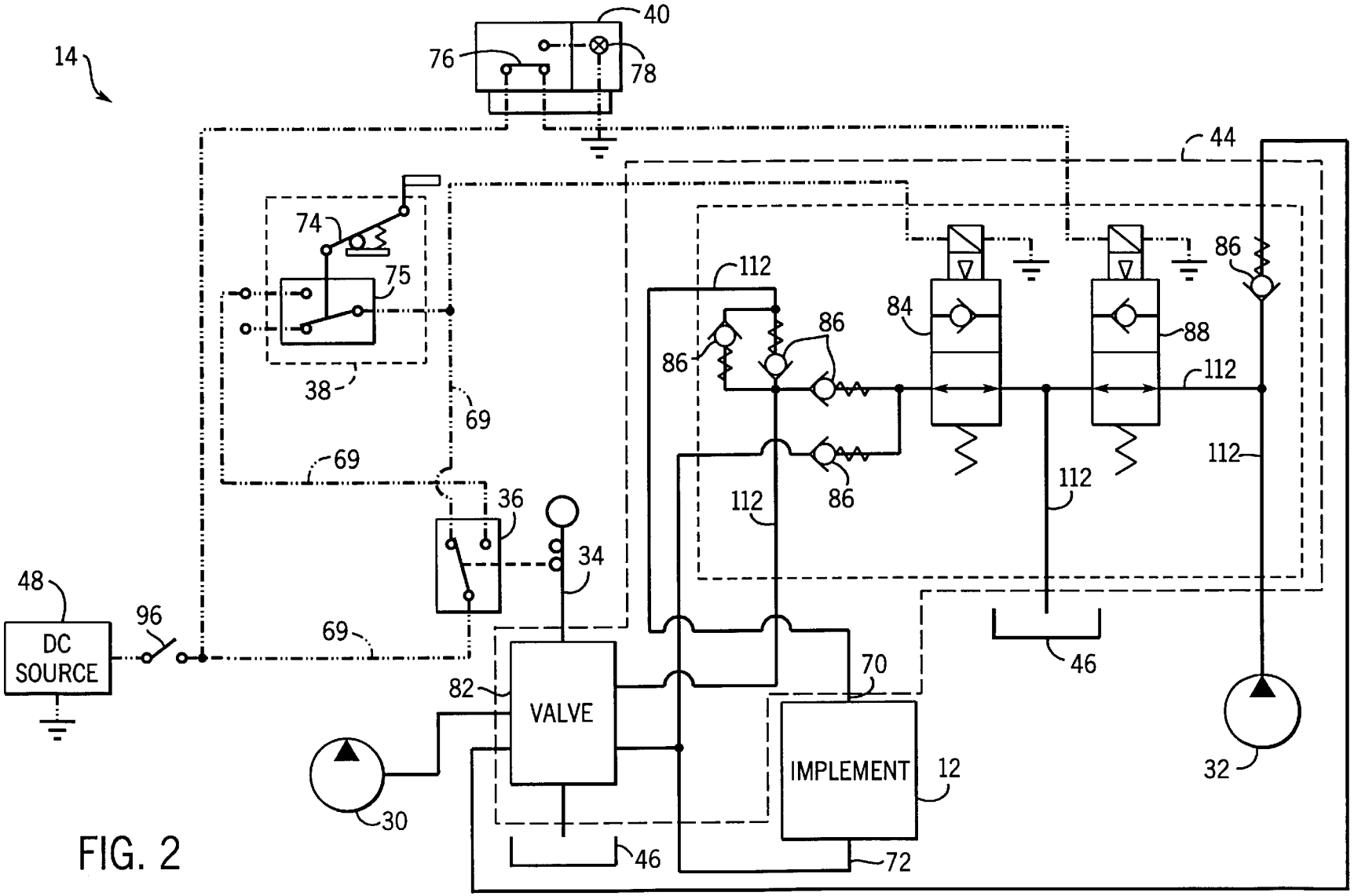
FIG. 2 is a schematic view illustrating the hydraulic fluid supply system of implement FIG. 1 with power to the system disenabled.

Foot pedal control 38 comprises a conventionally known foot pedal 74 and a conventionally known switch 75 operably coupled to one another and positioned near the floor of control station 15 (shown in FIG. 1). Foot pedal control 38 is electrically coupled between switch 36 and valve assembly 44. As shown by FIG. 2, foot pedal control 38 is placed in series between switch 36 and valve assembly 44. In response to receiving electrical current, which acts as a control signal, from switch 36 via electrical conductor 69, and in response to actuation of foot pedal control 38, preferably by depressment of foot pedal 74, switch 75 conducts the electrical current to valve assembly 44. This electrical current conducted by switch 75 of foot pedal control 38 acts as a control signal which is transmitted to valve assembly 44 and which causes valve assembly 44 to couple at least one of hydraulic pumps 30 and 32 to implement 12 via hydraulic coupling 70.

Flow control 40 is electrically coupled between power source 48 and valve assembly 44 and includes a conventionally known switch 76 and indicator light 78. Switch 76 is configured for movement between a low flow position in which switch 76 conducts electrical current from power source 48 to indicator light 78 and a high flow position in which switch 76 conducts the electrical current from power source 48 to valve assembly 44. Manual shifting of switch 76 between low and high positions generates control signals which are received by valve assembly 44 and which cause valve assembly 44 to add the hydraulic flow generated by hydraulic pump 32 to the hydraulic flow generated by hydraulic pump 30 to provide implement 12 with a high volumetric flow or which cause valve assembly 44 to divert the hydraulic flow generated by hydraulic pump 32 to sump 46 to provide implement 12 with a low volumetric flow. In the embodiment illustrated, flow control 40 is configured such that the conductance of electrical current via switch 76 to valve assembly 44 acts as the control signal for causing valve 44 to add the hydraulic flow generated by hydraulic pump 32 to the hydraulic flow generated by hydraulic pump 30. Alternatively, flow control 40 could be oppositely configured such that the conductance of electrical current to valve assembly 44 causes valve assembly 44 to divert the hydraulic flow generated by pump 32 to sump 46.

Figure 7:
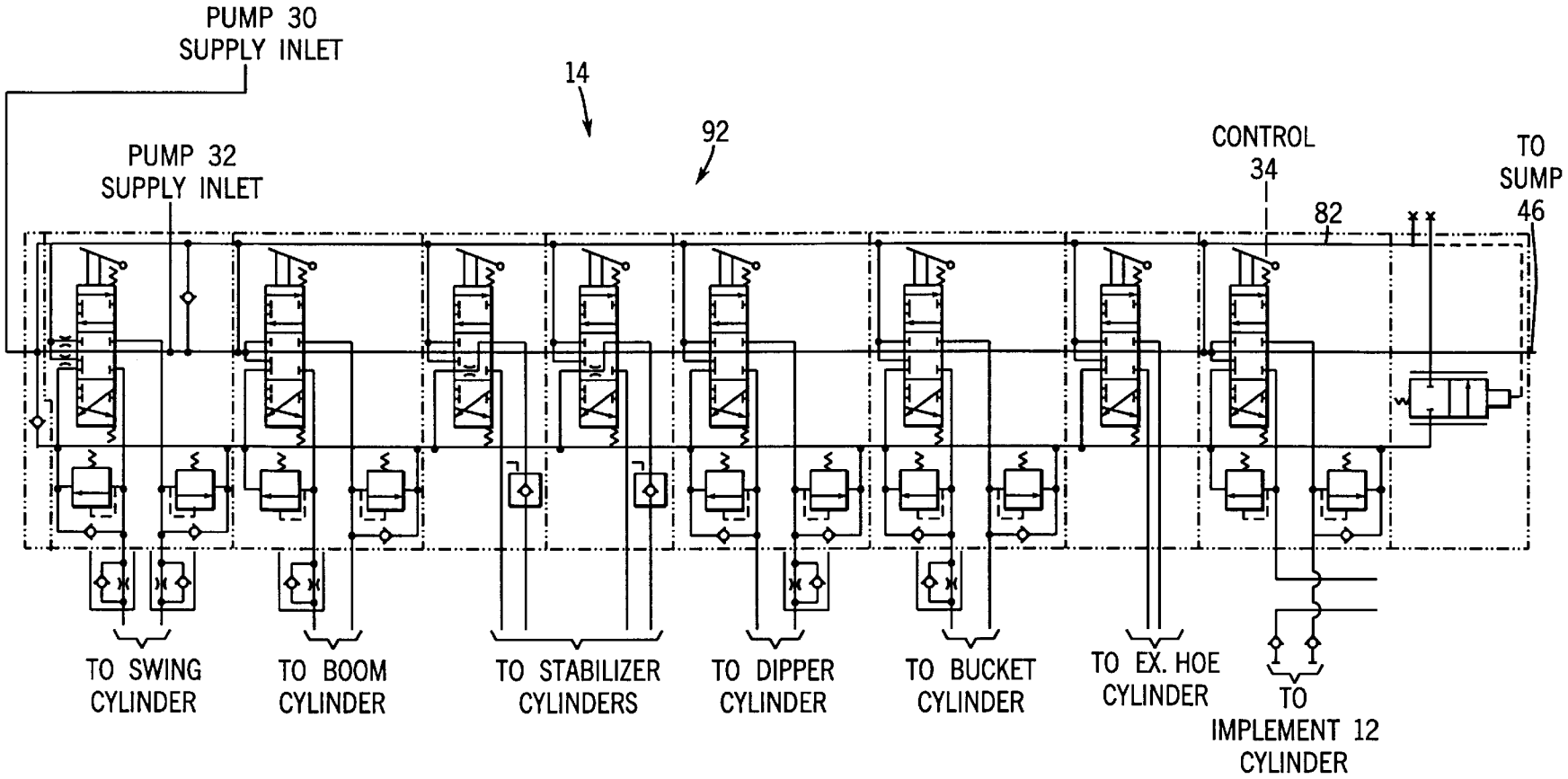
FIG. 7 is a schematic view illustrating a distribution valve of the hydraulic fluid supply system of FIG. 1.

Valve assembly 44 is coupled to hydraulic pumps 30 and 32 as well as sump 46. Upon receiving control signals from manually operable control 34 or from foot pedal control 38, valve assembly 44 supplies implement 12 with pressurized hydraulic fluid via either of hydraulic couplings 70 or 72. Upon receiving a control signal from flow control 40, valve assembly 44 adds the hydraulic flow generated by pump 32 to the hydraulic flow generated by pump 30. In the preferred embodiment illustrated, valve assembly 44 includes directional valve 82, safety valve 84, check valves 86 and flow control valve 88. Directional valve 82 is coupled to hydraulic pump 30 and is further coupled to manually operable control 34. Directional valve 82 receives the hydraulic flow from hydraulic pump 30 and selectively couples the hydraulic flow to implement 12 via coupling 70 or 72 in response to control signals received from manually operable control 34. In the preferred embodiment illustrated, directional valve 82 preferably comprises a conventionally known spool valve added to a bank of similar spool valves which are each adapted to selectively supply hydraulic fluid to a plurality of corresponding implements simultaneously. As best shown by FIG. 7, valve 82 is preferably incorporated into an eight spool bank 92 configured for simultaneously and selectively supplying hydraulic fluid to the cylinder of implement 12 as well as to the cylinders of a swing cylinder, a boom cylinder, stabilizer cylinders, a dipper cylinder, a bucket cylinder and extendable hoe cylinder. Alternatively, valve 82 may be incorporated into various other valve banks depending upon the particular machine or vehicle in which hydraulic fluid supply system 14 is employed.

Safety valve 84 comprises a conventionally known solenoid valve coupled to sump 46 and hydraulic couplings 70 and 72. Valve 84 is further electrically coupled to manually operable control 34 and switch 36 as well as foot pedal control 38. Valve 84 is mechanically biased towards an open position in which couples the hydraulic flow within either couplings 70 or 72 to sump 46 to prevent system 14 from accidentally supplying hydraulic fluid to implement 12. Valve 84 is preferably biased so as to couple coupling 70 and 72 to sump 46 at all times except when valve 84 receives a control signal (i.e., a sufficient amount of electric current) from either the manually operable control 34 and switch 36 or foot pedal control 38. Upon receiving electrical current, the solenoids of valve 84 cause valve 84 to close the thereby hydraulically connect hydraulic couplings 70 and 72 to implement 12.

Check valves 86 are located within hydraulic conduits 112 of valve assembly 44 to prevent run-on from low inertia devices, such as augers. Check valves 86 provide sufficient line resistance to prevent actuation of the implement from return side pressure.

Flow control valve 88 preferably comprises a conventionally known solenoid valve hydraulically coupled to hydraulic pump 32, sump 46 and valve 82. Valve 88 is also electronically coupled to flow control 40. Valve 88 is mechanically biased towards an open position so as to hydraulically couple the hydraulic flow from pump 32 to sump 46 until its solenoid is electrically actuated. Upon receiving control signals (i.e., a sufficient electrical current) from flow control 40, the solenoid of valve 88 closes valve 88 to couple the hydraulic flow from pump 32 to the hydraulic flow of pump 30. As a result, selective actuation of valve 88 in response to control signals from flow control 40 enables valves assembly 44 to selectively add the hydraulic flow from pump 32 to the hydraulic flow generated by pump 30 for providing both low and high hydraulic flows to valve 82 and ultimately to implement 12 independent of the RPM at which pumps 30 and 32 are driven.

Power source 48 preferably comprises a conventionally known DC power source selectively coupled to switch 36, foot pedal control 38 and flow control 40 by switch 96. Power source 48 provides the electric current to micro switch 36, foot pedal control 38 and flow control 40 so as to enable micro switch 36, foot pedal control 38 and flow control 40 to provide electrical control signals to valve assembly 44.

Figure 3:
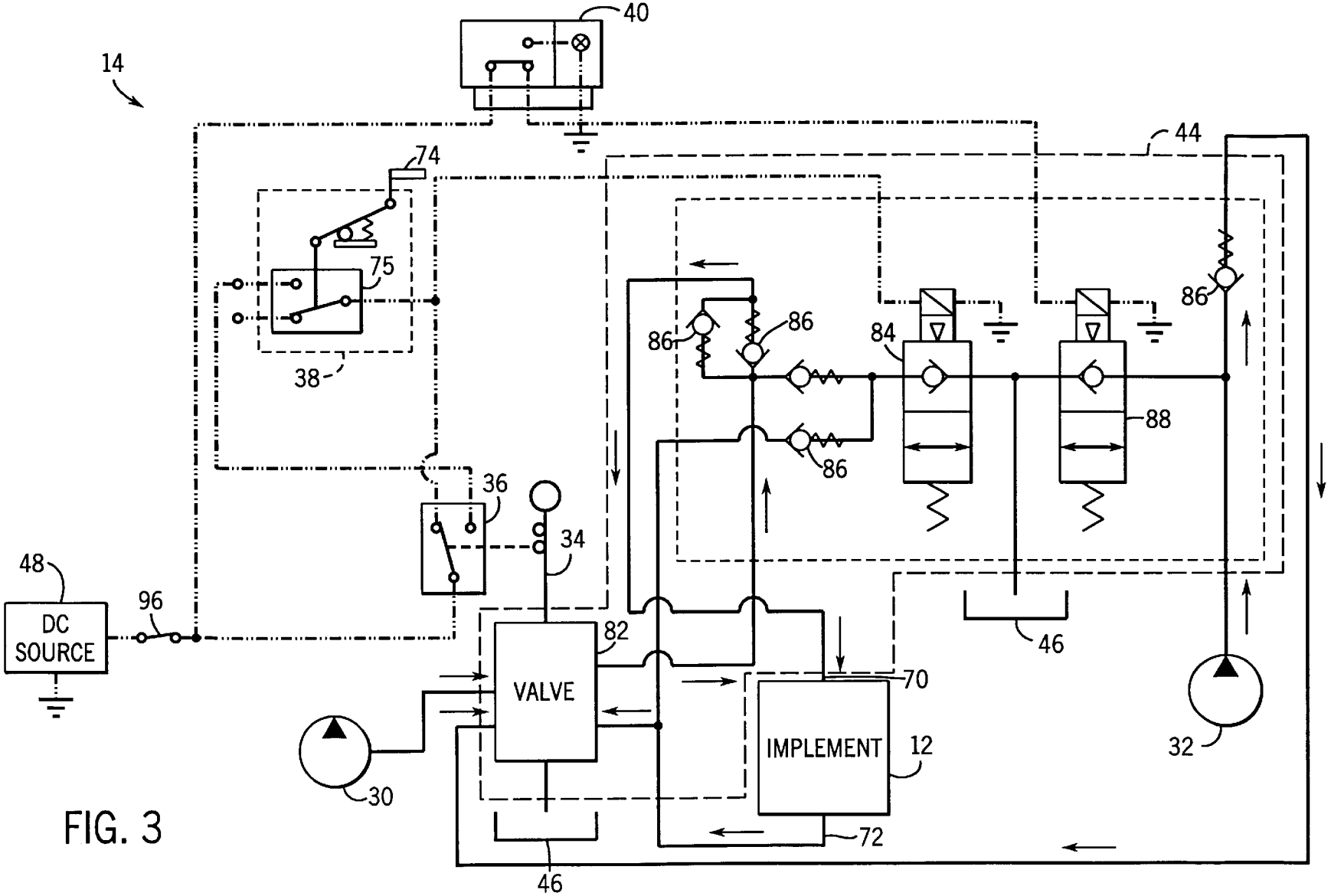
FIG. 3 is a schematic view illustrating the hydraulic fluid supply system actuated to provide high volumetric flow of hydraulic fluid to the implement utilizing a manually operable control.
Figure 4:
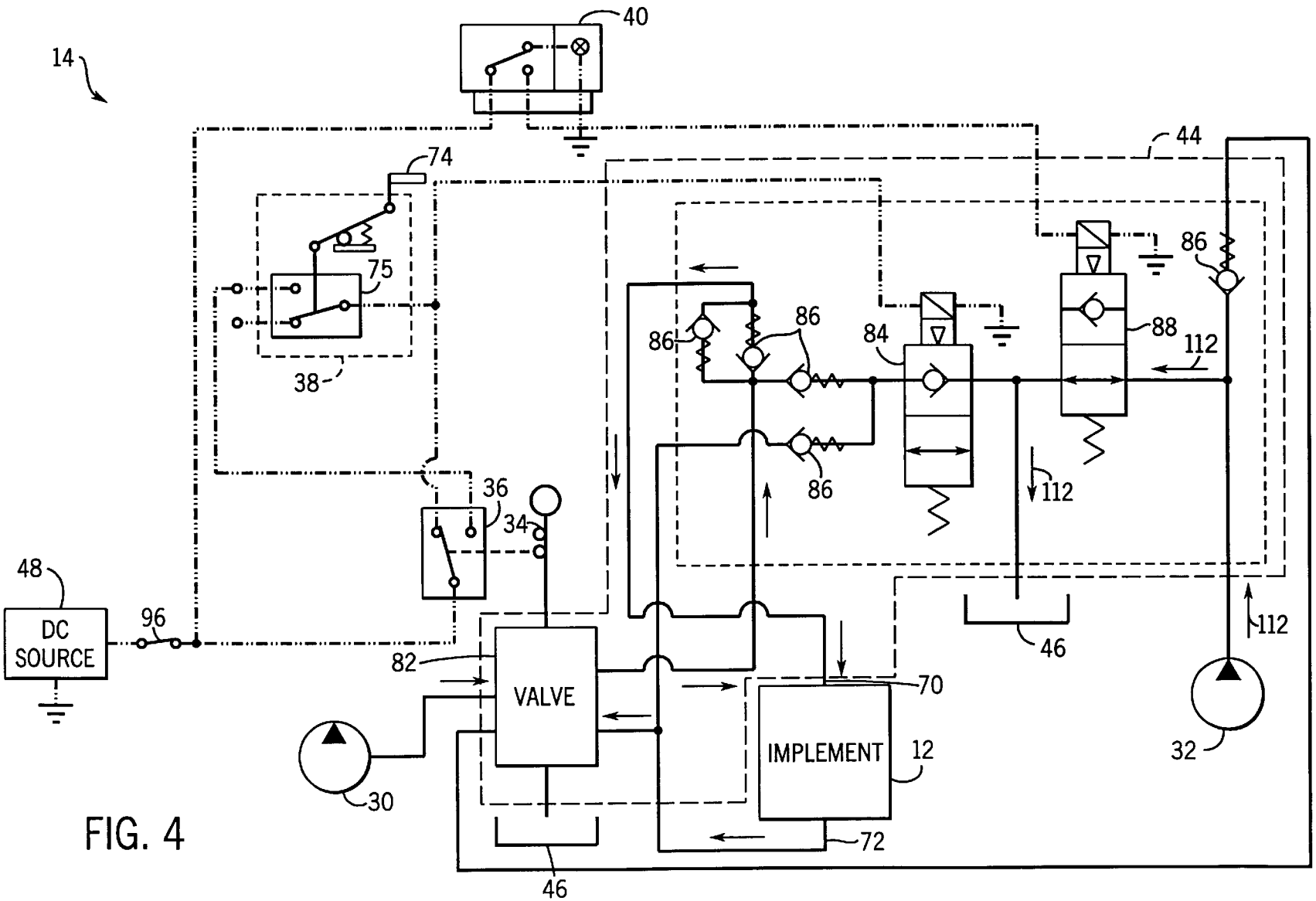
FIG. 4 is a schematic view illustrating the hydraulic fluid supply system and implement of FIG. 1 actuated to provide a low volumetric flow of hydraulic fluid to the implement utilizing the manually operable control.
Figure 5:
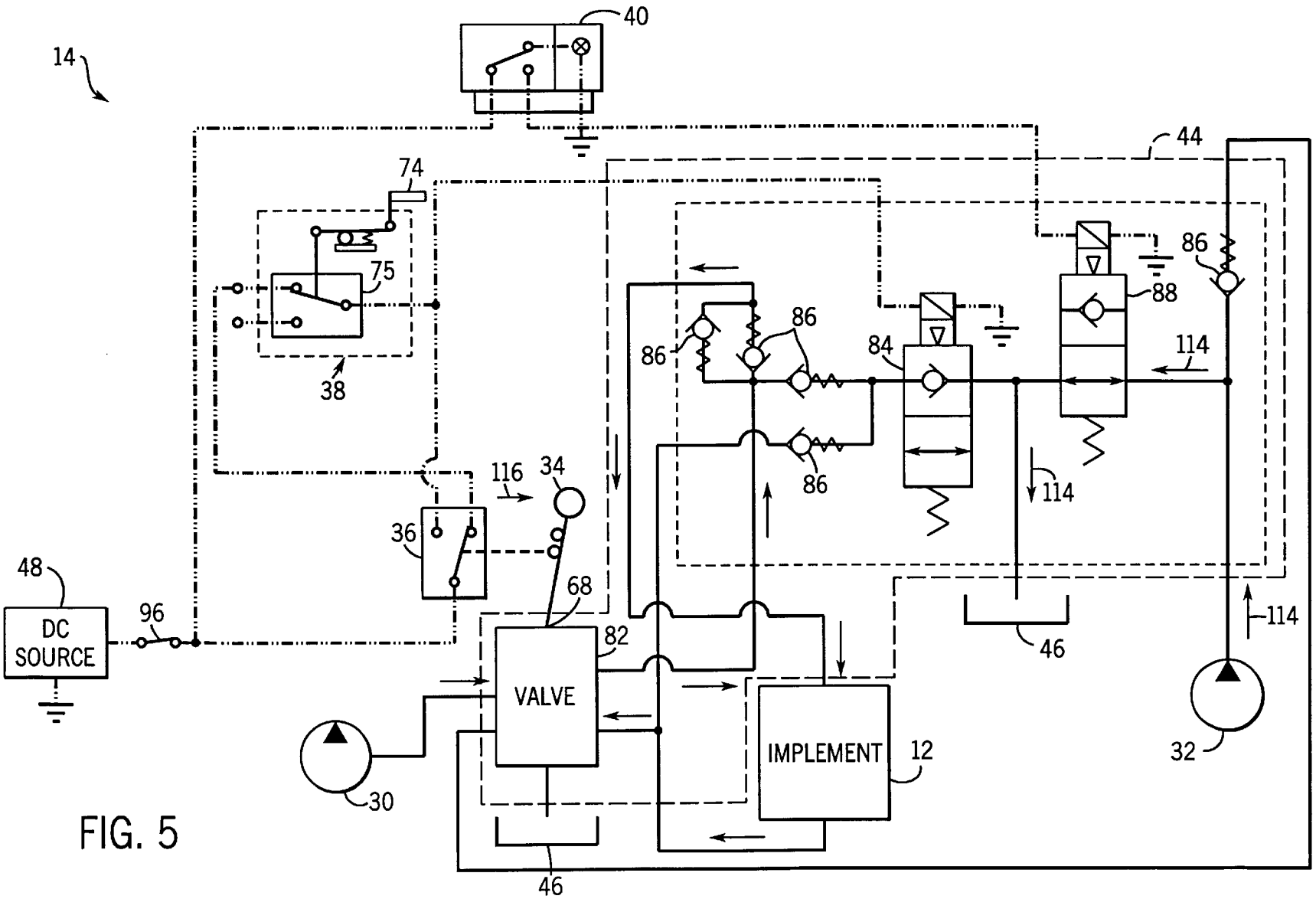
FIG. 5 is a schematic view illustrating the hydraulic fluid supply system and the implement of FIG. 1 actuated to provide a low volumetric flow of hydraulic fluid to the implement utilizing a foot pedal control.

FIGS. 2–5 illustrate various operating modes of system 14. FIG. 2 schematically illustrates system 14 with power to system 14 disenabled. FIG. 3 illustrates system 14 actuated to provide high volumetric flow of hydraulic fluid to implement 12 utilizing a manually operable control 34. FIG. 4 illustrates system 14 actuated to provide a low volumetric flow of hydraulic fluid to implement 12 utilizing a manually operable control 34. FIG. 5 illustrates system 14 actuated to provide a low volumetric flow of hydraulic fluid to implement 12 utilizing a foot pedal control. FIG. 2 illustrates power source 48 disconnected from switch 36, foot pedal control 38 and flow control 40 via switch 96. As a result, as shown by FIG. 2, micro switch 36, foot pedal control 38 and flow control 40 cannot generate and transmit electrical current to valve assembly 44 regardless of whether micro switch 36, foot pedal control 38 or flow control 40 are being actuated. Consequently, valve 84 of valve assembly 44 is biased to an open state such that valve 44 couples conduits 70 and 72 to sump 46. In addition, because valve 88 does not receive electrical energy to actuate solenoid valve 88, solenoid valve 88 is biased to its open state so as to couple the hydraulic flow generated by pump 32 to sump 46. As a result, both hydraulic flows generated by pumps 30 and 32 are diverted to sump 46 and do not reach implement 12.

FIG. 3 illustrates electric power source 48 coupled to switch 36, foot pedal control 38 and remote control 40 by switch 96. FIG. 3 further shows manually operable control 34 at position 62 (shown in FIG. 6) and switch 76 of flow control 40 actuated to transmit current from power source 48 to valve 88 of valve assembly 44. The transmission of current to valve 88 by flow control 40 serves as a control signal which causes valve 88 to decouple the hydraulic flow of pump 32 to sump 46 such that the hydraulic flow of pump 32 is added to the hydraulic flow of pump 30 for producing a high flow which is transmitted by valve 82 to implement 12 via coupling 70. Although not shown, shifting manually operable control 44 to position 64 (shown in FIG. 6) alternatively couples this high flow to implement 12 via coupling 72.

FIG. 4 illustrates hydraulic fluid supply system 14 actuated for providing low hydraulic flow to implement 12. FIG. 4 is similar to FIG. 3 except that FIG. 4 illustrates hydraulic fluid supply system 14 with switch 76 of flow control 40 shifted to a low flow position with manually operable control 34 at position 62. At the low flow position, switch 76 of flow control 40 transmits electric current from power source 48 through indicator lamp 76. As a result, indicator light 76 visually indicates that hydraulic fluid supply system 14 is in a low flow mode. In this low flow mode, electrical current from power source 48 is not transmitted to valve 88 of valve assembly 44. The lack of electrical current being supplied to valve assembly 44 acts as a control signal that causes valve 88 to return to its open state under a mechanical bias such that the hydraulic flow from hydraulic pump 32 is coupled to sump 46 as indicated by arrows 114. As a result, valve 82 couples only the hydraulic flow generated by hydraulic pump 30 to implement 12 via hydraulic couplings 74. Because valve 88 couples the hydraulic flow from pump 32 to sump 46 prior to the hydraulic flow from pump 32 flowing completely through valve 82 to hydraulic coupling 70, hydraulic fluid supply system 14 provides low hydraulic flow to implement 12 without excessive heat generation and without the associated parasitic losses. Consequently, hydraulic fluid supply system 14 is capable of efficiently providing both high and low hydraulic flows to implement 12 independent of the RPM at which pumps 30 and 32 are driven. Although not illustrated, hydraulic fluid supply system 14 may alternatively provide a low hydraulic flow to implement 12 via couplings 72 upon the operator shifting manually operable control 34 to position 64 (shown in FIG. 6).

FIG. 5 illustrates hydraulic fluid supply system 14 actuated for being controlled by a foot pedal 38 to free the operator's hands for other operations. FIG. 5 illustrates manually operable control lever 34 shifted to a detent position 68 as indicated by arrow 116 and as shown in FIG. 6. As shown by FIG. 5, at position 68, manually operable control lever 34 acts upon switch 36, preferably through a mechanical linkage, to cause switch 36 to transmit electrical current from power source 48 to foot pedal control 38. The electrical current transmitted by switch 36 to foot pedal control 38 acts as a control signal. Depressment of foot pedal 74 of control 38 acts upon switch 75 to cause foot pedal control 38 to further transmit the electrical current from switch 36 to valve 84. The electrical current transmitted from foot pedal control 38 to valve 84 acts an electrical control signal that causes valve 84 to couple the hydraulic flow generated by pump 30 to implement 12 and at the same time decouple hydraulic conduits 70 and 72 from sump 46. Upon the operator ceasing to actuate foot pedal control 38, switch 75 ceases conducting the electrical current from switch 36 to valve 84. This cessation of electrical current from the foot pedal control 38 also serves as a control signal and causes valve 84 to be biased by mechanical means to its open position (shown in FIG. 2) in which hydraulic couplings 70 and 72 are once again coupled to sump 46 such that hydraulic fluid supply system 14 no longer supplies hydraulic fluid to implement 12. Thus, movement of manually operable control 34 to the detent position 68, as indicated by arrow 116, shifts hydraulic fluid supply system 14 from manual bi-directional flow control via control 34 to single direction flow control via foot pedal control 38. This shifting between manual and foot pedal flow control is achieved by simply actuating the same manual control 34 used for manual bi-directional flow control. As a result, the control system provided by hydraulic fluid supply 14 preserves console space and is simple and easy to use and manipulate. Although FIG. 5 illustrates flow control 40 of hydraulic fluid supply system 14 actuated so as to provide low hydraulic flow to implement 12 in response to actuation of foot pedal control 38, flow control 40 may alternatively be actuated to its high flow position to provide high hydraulic flow to implement 12 in response to actuation of foot pedal control 38.

Although system 14 comprises the present preferred embodiment, numerous variations are contemplated. For example, although valve assembly 44 is illustrated as utilizing solenoid valves which are biased towards open states, other conventional valve mechanisms may also be employed. Furthermore, in lieu of electronic switches, other control signal generating devices could be employed. As can be appreciated, the control signals which act upon valve assembly 44 may be in the form of positive electrical current, changes in electrical current or the lack of electrical current where mechanical biasing is employed. Moreover, although less desirable, the control signal generating devices may also be hydraulic, pneumatic or mechanical in nature.

Although the present invention has been described with reference to preferred embodiments, workers skilled in the art will recognize that changes may be made in form and detail without departing from the spirit and scope of the invention. The present invention described with reference to the preferred embodiments and set forth in the following claims is manifestly intended to be as broad as possible. For example, unless specifically otherwise noted, the claims reciting a single particular element also encompass a plurality of such particular elements.

What is claimed is:

1. A loader/backhoe tractor comprising:

a frame having a front end and a rear end;

a plurality of ground engaging motive members supporting the frame above ground;

a hydraulically actuated bucket supported by the tractor at the front end of the frame;

a hinged arm supported by the tractor at the rear end of the frame;

an hydraulically actuated implement supported by the hinged arm;

a first hydraulic pump generating a first flow;

a valve assembly coupled to the first hydraulic pump and coupled to the implement via a first coupling and via a second coupling, wherein the valve assembly couples the first pump to the implement via the first coupling in response to a first signal, wherein the valve assembly couples the pump to the implement via the second coupling in response to a second signal;

a manually operable control coupled to the valve assembly, the control being movable between a first position at which the first signal is generated, a second position at which the second signal is generated, and a third position at which a third signal is generated; and a foot pedal control coupled to the manually operable control and to the valve assembly, wherein the first signal is generated in response to the third signal and actuation of the foot pedal control.

2. The system of claim 1, including a second hydraulic pump generating a second flow, wherein the valve assembly is coupled to the first and second flows and couples the first flow to the implement and wherein the valve assembly selectively adds the second flow to the first flow.

* * * * *